US008651078B2

(12) United States Patent
Fasold et al.

(10) Patent No.: US 8,651,078 B2
(45) Date of Patent: Feb. 18, 2014

(54) OIL PAN FOR AN INTERNAL COMBUSTION ENGINE

(75) Inventors: Michael Fasold, Auenwald (DE); Holger Findeisen, Marbach (DE); Thomas Jessberger, Asperg (DE)

(73) Assignee: Mann + Hummel GmbH, Ludwigsburg (DE)

( * ) Notice: Subject to any disclaimer, the term of this patent is extended or adjusted under 35 U.S.C. 154(b) by 415 days.

(21) Appl. No.: 12/948,116

(22) Filed: Nov. 17, 2010

(65) Prior Publication Data

US 2011/0283965 A1 Nov. 24, 2011

(30) Foreign Application Priority Data

Nov. 19, 2009 (DE) ..... 10 2009 053 682

(51) Int. Cl.

| | |
|---|---|
| ***F01M 1/06*** | (2006.01) |
| ***F01M 9/10*** | (2006.01) |
| ***F02M 25/00*** | (2006.01) |
| ***F01M 11/03*** | (2006.01) |
| ***F01M 11/10*** | (2006.01) |
| ***F01M 3/04*** | (2006.01) |
| ***F01L 5/04*** | (2006.01) |
| ***F02B 75/00*** | (2006.01) |
| ***F01M 1/04*** | (2006.01) |

(52) U.S. Cl.

USPC ..... 123/90.33; 123/196 R; 123/198 E; 123/196 A; 123/196 S; 123/196 M; 123/196 V; 123/196 W; 123/196 CP

(58) Field of Classification Search

USPC ..... 123/90.33, 196 R, 198 E, 196 A, 196 M, 123/196 S, 198 CP, 196 V, 196 W

See application file for complete search history.

(56) References Cited

U.S. PATENT DOCUMENTS

| | | | | | |
|---|---|---|---|---|---|
| 1,653,476 | A | * | 12/1927 | Smith | 123/196 R |
| 4,134,380 | A | * | 1/1979 | Niwa et al. | 123/142.5 R |
| 4,429,422 | A | * | 2/1984 | Wareham | 4/676 |
| 4,519,348 | A | * | 5/1985 | Hamilton | 123/195 C |
| 5,038,890 | A | * | 8/1991 | Tanaka et al. | 184/6.5 |
| 5,301,642 | A | * | 4/1994 | Matsushiro et al. | 123/196 AB |
| 5,954,159 | A | * | 9/1999 | Nakamura | 184/11.2 |
| 2001/0042532 | A1 | * | 11/2001 | Aichinger et al. | 123/192.1 |

(Continued)

FOREIGN PATENT DOCUMENTS

| | | |
|---|---|---|
| DE | 10002256 | 8/2001 |
| DE | 102004043936 | 3/2006 |

(Continued)

OTHER PUBLICATIONS

Oil Pan Drain Screw, 2010, http://pedrn44.hubpages.com/hub/Oil-Pan-Plug-Easy-Repair.*

(Continued)

*Primary Examiner* — Lindsay Low
*Assistant Examiner* — Charles Brauch
(74) *Attorney, Agent, or Firm* — James Hasselbeck

(57) ABSTRACT

An oil pan for an internal combustion engine has a pan body and a partition disposed in the pan body so as to separate an interior of the pan body into two separate oil chambers. The partition is provided with at least two overflow openings. An adjustable closure element is common to the at least two overflow openings for opening or closing the at least two overflow openings.

8 Claims, 2 Drawing Sheets

(56) References Cited

U.S. PATENT DOCUMENTS

| | | | | |
|---|---|---|---|---|
| 2003/0019462 | A1* | 1/2003 | Baumann et al. | 123/196 A |
| 2003/0101960 | A1* | 6/2003 | Tsuchiya et al. | 123/196 R |
| 2004/0079318 | A1* | 4/2004 | Batzill et al. | 123/195 C |
| 2006/0180541 | A1* | 8/2006 | Hueppchen et al. | 210/450 |
| 2006/0288976 | A1* | 12/2006 | Watanabe | 123/196 R |

FOREIGN PATENT DOCUMENTS

| | | | |
|---|---|---|---|
| DE | 102004043936 | A1 | 3/2006 |
| DE | 10002256 | B4 | 6/2008 |
| JP | 57-076217 | A | 5/1982 |
| JP | 57076217 | | 5/1982 |
| JP | 2006-105118 | A | 4/2006 |
| JP | 2006105118 | | 4/2006 |
| JP | 2006-242052 | A | 9/2006 |
| JP | 2006242052 | | 9/2006 |

OTHER PUBLICATIONS

DPMA (German Patent Office) Office Action on 10 2009 053 682.5. Office Action German Patent and Trademark Office of DE 102009053682.5-13.

* cited by examiner

OIL PAN FOR AN INTERNAL COMBUSTION ENGINE

CROSS REFERENCE TO RELATED APPLICATIONS

This application claims the benefit under 35 USC 119 of foreign application 102009053682.5 filed in Germany on Nov. 19, 2009, and which is hereby incorporated by reference in its entirety.

BACKGROUND OF THE INVENTION

The invention concerns an oil pan for an internal combustion engine.

JP 2003278519 A discloses that the interior of an oil pan for an internal combustion engine is to be separated by a partition into two separate chambers of approximately the same size that are each fillable with oil. The oil is drained through a drain passage that is provided in one of the two chambers. This separation into two chambers has the advantage that, as a result of the reduced oil volume for each chamber, the oil can be heated in a shorter time to the operating temperature. In the partition between the two chambers several overflow openings are provided wherein each overflow opening can be opened or closed by a correlated temperature-dependent switching valve. When a limit temperature is surpassed, the switching valves are opened so that through the overflow openings a fluid communication between the two chambers is produced and the oil volume of the two chambers can be supplied to the oil circulation.

SUMMARY OF THE INVENTION

It is therefore an object of the present invention to embody with simple measures and a compact configuration an oil pan for an internal combustion engine such that the oil temperature can be brought to operating temperature within a time that is as short as possible. Moreover, according to a further aspect, the drainage of the oil pan for servicing purposes should be performable with minimal additional constructive expenditure.

In accordance with the present invention, this is achieved in that at least two overflow openings in the partition are to be opened or closed by a common closure element.

The oil pan according to the invention for an internal combustion engine has in the interior at least two separate oil chambers that are separated by an intermediately positioned partition wherein in the partition at least two overflow openings are provided. For opening and closing the overflow openings, an adjustable closure element is provided wherein, according to the invention, at least two overflow openings are to be opened and closed by a common closure element.

With this embodiment, a significant constructive simplification and a more compact configuration are provided because the number of closure elements is smaller than the number of overflow openings. For example, in an embodiment with two overflow openings in the partition between the two oil chambers in the oil pan, only a single closure element is required with which the two overflow openings, preferably simultaneously, are opened or closed. As an alternative to simultaneous opening and closing, a temporally delayed opening and closing of the two overflow openings is possible also in order to provide, for example, for improved control of the flow exchange between the oil chambers, in particular, as a function of the current oil temperature.

The closure element is in particular a thermal switching valve that, below a switching temperature, is in closed position so that the two volumes in the oil chambers are separated and that is switched upon surpassing the switching temperature from the closed position into an open position so that an exchange between the oil chambers is possible through the overflow openings.

The partition between the oil chambers is expediently designed such that two opposed wall sections are formed each provided with an overflow opening, respectively, wherein the closure element is arranged in the intermediate space between the wall sections. In this way, several design possibilities in regard to the geometry of the oil chambers are provided wherein even for complex geometries only one closure element for at least two overflow openings is required. Positioning of the closure element in the intermediate space between the opposed wall sections of the partition enables closing and opening of both overflow openings with only one closure element. For example, the partition is U-shaped so that the opposed wall sections of the U-shape extend at least approximately parallel and the overflow openings can be opened or closed by means of the intermediately positioned closure element. Possible in principle are also angled arrangements between the wall sections of the partition. In this variant, opening and closing is possible also with only one closure element. Since advantageously each wall sections in the partition has correlated therewith at least one overflow opening, oil chamber geometries with undercuts can be formed without there being the risk that oil collected in partial areas of an oil chamber will no longer participate in the flow exchange or flow transfer into the second chamber. Instead, it is ensured that the oil from all areas of the closed chamber will flow into the second chamber upon opening of the closure element.

As a closure element an oil drain screw may be provided also that is adjustable between a closing position and an open position. According to an advantageous embodiment, it is provided that the oil drain screw is passed additionally through a drain opening in the exterior wall of the oil pan so that, on the one hand, the overflow openings in the partition between the oil chambers can be opened and closed and, on the other hand, for servicing purposes, the drain opening in the exterior wall can also be opened and can be closed again after termination of the servicing work. All openings, i.e., the overflow openings in the partition and the drain opening in the exterior wall, are closed with a common closure element in form of an oil drain screw. The oil drain screw has, axially spaced, several sealing locations that, in the closed position, project into correlated sealing seats in the openings and close them off.

According to a first embodiment variant, the oil drain screw is embodied in a conventional embodiment with sealing locations that are axially fixedly positioned relative to one another. In an advantageous embodiment variant, it is provided that the oil drain screw in addition has a thermal expansion section that has the function of a thermal element and that, based on the oil temperature, expands or contracts so that the axial length of at least one section of the oil drain screw will change as a function of temperature. In this embodiment, the oil drain screw has two functions. On the one hand, the oil drain screw can be removed manually in order to release the drain opening in the exterior wall for draining the oil and, at the same time, to release the overflow openings in the partition so that the entire oil can drain from the oil pan. On the other hand, the oil drain screw in operation remains in its position and closes the externally positioned drain opening, while the wax thermostatic element will axially move the sealing locations on the oil drain screw that close off the overflow openings. In this way, as a function of temperature, opening and closing of the overflow openings in the partition is possible, even when the oil drain screw remains in the inserted position in the drain opening.

Inasmuch as the closure element is embodied as a thermal switching element that does not additionally have the task of an oil drain screw, different embodiment variants may be considered, for example, an embodiment as a rotary slide with a bimetal spring that, as a function of temperature, produces a rotational movement that is used as an adjusting movement for opening and closing the overflow openings. Alternatively, a wax thermostatic element can be employed as thermal switching element.

According to a further aspect of the invention, the oil pan has also a partition for separating the interior into two oil chambers wherein in the partition at least one overflow opening is introduced that is to be closed by an oil drain screw. In this embodiment, the oil drain screw also has the function of opening and closing the drain opening in the exterior wall as well as the overflow opening in the partition. Basically, a single overflow opening in the partition is sufficient that is closed by the oil drain screw. The oil drain screw, as described above, can be provided as is conventional with sealing locations that are axially fixedly positioned for closing the drain opening and the overflow opening, or with a wax thermostatic element that, as a function of temperature, axially moves the sealing location for the overflow opening in order to open or close the overflow opening as a function of the oil temperature.

According to further aspect, in the partition between the oil chambers at least one overflow opening is provided whose cross-sectional surface area and/or cross-sectional geometry is matched to the viscosity of the oil in such a way that only oil with a viscosity below a temperature-dependent viscosity limit can pass the overflow opening. Since the oil at low temperatures has a higher viscosity than at higher temperatures, by means of the design of the cross-sectional shape and the cross-sectional surface area of the overflow opening the flow through the opening can be controlled which has the advantage that a thermal switching valve or other closure element as a separately embodied component for closing the overflow opening is no longer needed. For example, the overflow opening is designed as a slot in order to prevent oil exchange at low temperatures because the slot shape cannot be passed by high-viscosity oil at low temperatures. With increasing temperature, the viscosity of the oil decreases until upon surpassing a switching temperature at which the viscosity limit is reached, the oil can be exchanged through the overflow opening between the oil chambers. Alternatively, the overflow opening can be round, oval or rectangular.

As an alternative to the embodiment with reduced cross-sectional surface area or slot-shaped cross-sectional geometry, it is also possible to arrange within the overflow opening a nonwoven that has a permeability that is matched to the viscosity of the oil in such a way that below a temperature-dependent viscosity limit the oil can pass the nonwoven while highly viscous oil that is above the viscosity limit cannot pass through the nonwoven so that the overflow opening is closed and the oil volumes in the chambers are separated from one another. This embodiment has the advantage that the overflow opening may have a large cross-sectional surface area because the overflow behavior is determined by the nonwoven in the overflow opening. Several overflow openings may be provided that are covered by the nonwoven or by several nonwoven sections.

According to a further aspect of the invention the partition is connected with the inner bottom of the oil pan according to the tongue-and-groove principle. This embodiment has the advantage that additional fixation or fastening measures of the partition in the oil pan are not required. The connection between partition and oil pan is realized only means of the tongue-and-groove principle, in particular in such a way that on the inner bottom of the oil pan a groove is provided into which the end face of the partition is inserted. The groove at the inner bottom of the oil pan is comprised either of the same material as the oil pan or of a softer material, for example, a thermoplastic elastomer that is applied to the inner bottom, for example, by way of injection molding.

The connection of the partition with the inner bottom of the oil pan according to the tongue-and-groove principle can be provided optionally with a desired play or clearance that, with respect to the size or cross-sectional design, is configured in analogy to the slot-shaped overflow openings such that only oil below the viscosity limit can pass through the clearance. Since the viscosity depends on the oil temperature, by means of the defined clearance a switching function can be realized so that oil transfer at low temperatures is prevented and at higher temperatures is enabled. In addition or as an alternative to the play or clearance, in the area of the tongue-and-groove arrangement also overflow openings can be provided that with regard to their cross-sectional design and cross-sectional surface area are matched to a temperature-dependent oil exchange.

BRIEF DESCRIPTION OF THE DRAWING

In the Figures, same components are identified with the same reference numerals.

DESCRIPTION OF THE PREFERRED EMBODIMENTS

Figure 1:
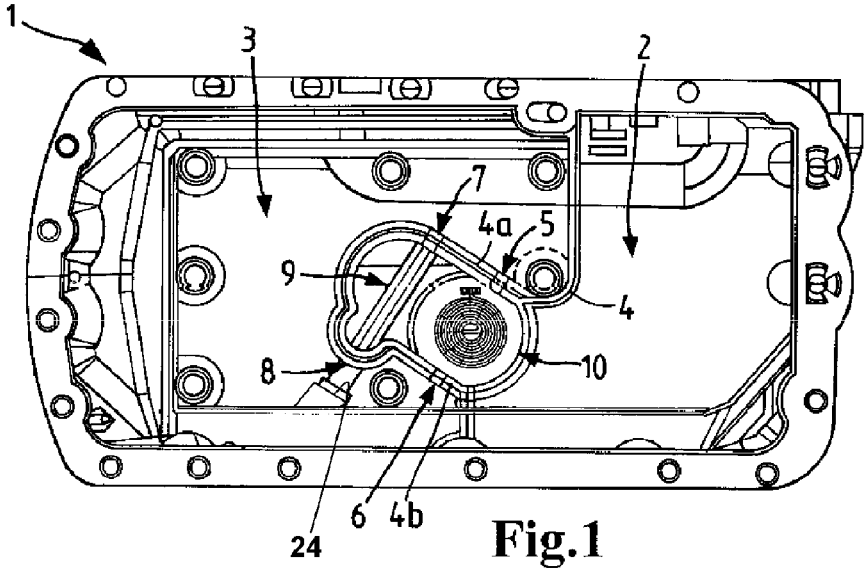
FIG. 1 is a plan view of an oil pan whose interior is separated by a partition into two oil chambers wherein the partition has sectionwise a U-shape and in oppositely positioned wall sections of the partition overflow openings are provided that are to be opened or closed by an oil drain screw or a thermal switching element.

The oil pan 1 illustrated in FIG. 1 that is arranged at the bottom side of a crankcase of an internal combustion engine has a pan body with an interior with two oil chambers 2 and 3, separated from one another by a partition 4. The partition 4 may enclose optionally the oil chamber 3 completely and can be designed as a circumferentially extending wall inserted into the oil pan 1 and connected to the bottom as well as optionally to the sidewalls of the pan body. Moreover, the oil chamber 3 can be closed off by a lid. The second oil chamber 2 is however open in the upward direction.

In order to a enable a flow exchange between the oil chambers 2 and 3, in the partition 4 overflow openings 5, 6, 7, 8 are introduced that are to be closed by the closure elements 9 and 10. The partition 4 has a U-shaped section wherein the overflow openings 5 to 8 are provided in the approximately parallel extending wall sections 4*a* and 4*b* of the U-shaped section. The oppositely positioned overflow openings 5 and 6 are closed by the closure element that is embodied as a thermal switching valve 10 and the overflow openings 7 and 8 also oppositely positioned relative to each other by a closure element that is embodied as an oil drain screw 9. Overflow openings 5, 6 or 7, 8 that are immediately positioned opposite one another are closed or opened by a common closure element 10 or 9.

The thermal switching valve 10 switches temperature-dependent and is moved into a closed position at an oil temperature that is below a switching or limit temperature. When the oil temperature surpasses the switching temperature, the thermal element 10 is moved into the open position and the overflow openings 5, 6 are opened so that the oil exchange between the chambers 2 and 3 is enabled.

Both closure elements, i.e., the oil drain screw 9 as well as the thermal switching valve 10, are arranged in the U-shaped intermediate space between the parallel wall sections 4*a*, 4*b*. Upon opening the closure elements, complete drainage or exchange of oil is possible, particularly even from sections of the separated oil chamber 3 that, as a result of the complex geometry of the oil chamber 3, may be located in undercut areas.

Figure 2:
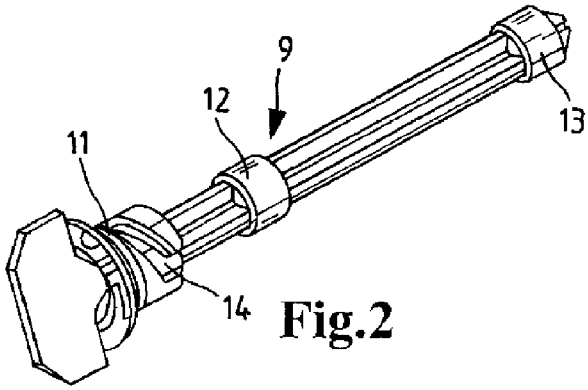
FIG. 2 shows an oil drain screw in a perspective detail illustration.

The oil drain screw 9, as is shown in FIG. 1 in connection with FIG. 2, is embodied as a substantially cylindrical component and closes off in addition to the oppositely positioned overflow openings 7 and 8 also a drain opening 24 that is introduced into the exterior wall of the oil pan. Upon removal of the oil drain screw 9 the two overflow openings 7 and 8 as well as the drain openings of the external wall are opened.

As can be seen in the detail illustration according to FIG. 2, the oil drain screw 9 is provided at its wall surface with three axially spaced-apart sealing locations 11, 12, and 13 that in the closed state of the screw rest seal-tightly in the drain opening and the overflow openings 7 and 8. Adjacent to the actuation grip of the oil drain screw, a groove 14 is introduced into the wall surface that extends with a component in axial direction and circumferential direction and is engaged by a matching engagement element of the oil pan, in particular adjacent to the drain opening, so that upon rotation of the oil drain screw an axial adjusting movement for opening and closing the openings is achieved at the same time.

Figure 3:
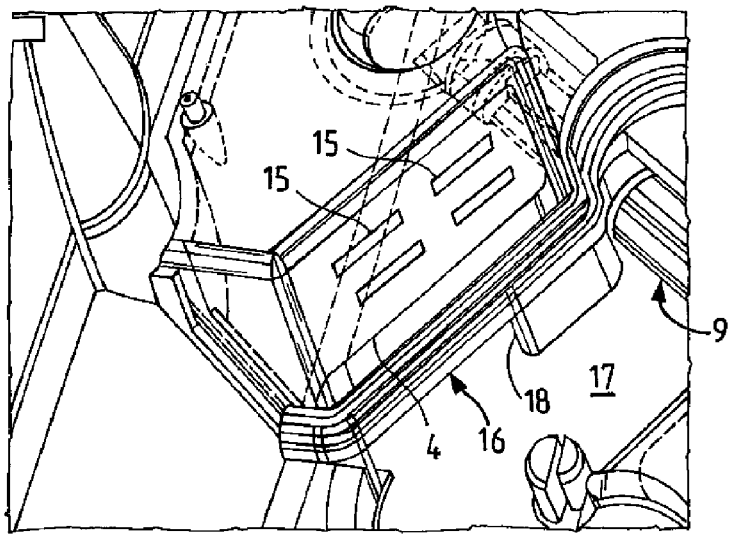
FIG. 3 shows a detail view of the partition between the oil chambers.

As can be seen in FIG. 3, into the partition 4 several approximately slot-shaped overflow openings 15 can be introduced that are not closed by a closure element but are exposed. These slot-shaped overflow openings 15 with regard to their configuration and surface area are designed such that oil with increased viscosity at low temperatures cannot pass through to a significant extent while at lower viscosity, reached upon higher oil temperatures, transfer through the overflow openings 15 is possible. This embodiment variant has the advantage that no closure elements for closing the overflow openings are required.

Optionally, the overflow openings 15 are covered by a nonwoven attached to the partition 4. The nonwoven has a permeability that is matched to the viscosity of the oil. Advantageously, the nonwoven is designed such that only oil at a viscosity below a limit value can pass through; the viscosity limit value is determined as a function of the oil temperature and the resulting viscosity. This embodiment has the advantage that even larger overflow openings can be provided because the passage of oil is determined by the nonwoven.

In FIG. 3 also a connection of the partition 4 with the inner bottom 17 of the oil pan is illustrated. The connection is realized by a tongue-and-groove arrangement in that the end face of the partition 4 that is facing the bottom 17 is inserted into a groove provided at the bottom; the groove is in particular embodied as an integral injection-molded component, for example, made of thermoplastic elastomer.

It may be expedient to provide in the area of the tongue-and-groove connection or arrangement 16 an opening 18 that, similar to the slot-shaped overflow openings 15, has the task to enable an oil transfer as soon as a limit temperature is surpassed. The opening 18 is either introduced into the groove into which the end face of the partition is inserted or is embodied as a recess in the area of the end face or as an opening in the inner bottom 17 below the groove. Moreover, it is possible to provide the tongue-and-groove connection at least sectionwise with play or clearance so that the gap that is caused by means of the play or clearance also enables a flow transfer as soon as the oil has surpassed a limit temperature and the viscosity has dropped below a correlated limit value.

Figure 4:
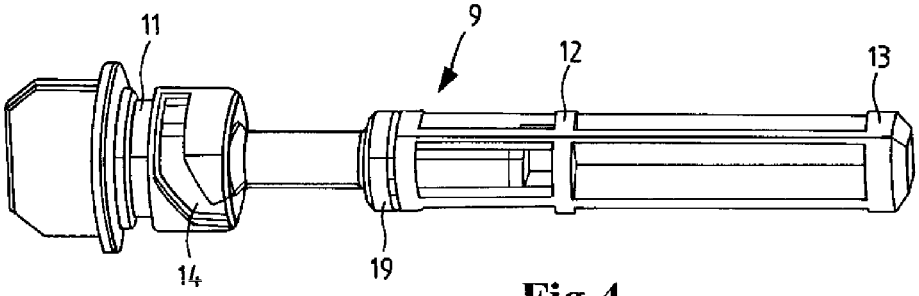
FIG. 4 shows an oil drain screw with an integrated wax thermostatic element.

In FIG. 4 an embodiment variant of an oil drain screw 9 is illustrated. The oil drain screw 9 has a wax thermostatic element 19 that forms a section of the oil drain screw 9 and has the function of a thermal switching element. The two sealing locations 12 and 13 that serve for closing the overflow openings in the partition are moved with respect to their axial position upon axial expansion or contraction of the wax thermostatic element 19, caused by a temperature differential, so that opening or closing of the overflow openings is effected. The wax thermostatic element 19 reacts to temperature changes of the oil located in the oil pan so that the overflow openings, even for essentially unchanged position of the oil drain screw, are opened or closed upon temperature change.

Figure 5:
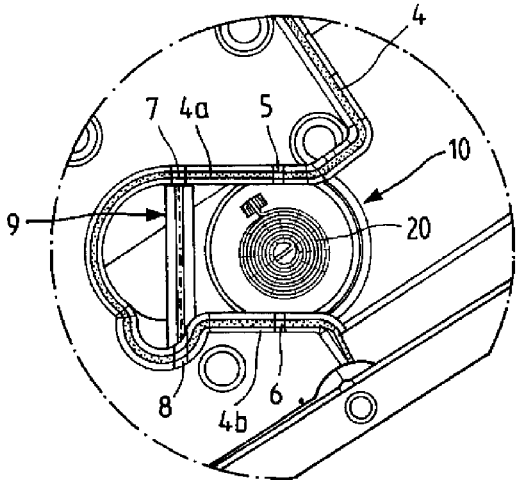
FIG. 5 is a detail view of a thermal switching valve that is embodied as a rotary slide with a bimetal spring.

FIG. 5 shows a detail illustration in the area of the U-shaped partition 4 with a closure element 10 inserted between the wall sections 4*a* and 4*b* and embodied as a thermal switching valve. The thermal switching valve 10 is embodied as a rotary slide with a bimetal spring 20 that forms a spiral spring and is reacting to temperature changes of the oil. Depending on the current oil temperature, the overflow openings 5 and 6 in the wall sections 4*a*, 4*b* of the partition 4 that are positioned opposite one another are opened or closed by the thermal switching element 10.

While specific embodiments of the invention have been shown and described in detail to illustrate the inventive principles, it will be understood that the invention may be embodied otherwise without departing from such principles.

What is claimed is:

1. An oil pan for an internal combustion engine comprising:

a pan body having a drain opening in an exterior wall of the pan body for draining oil from said pain body;

a partition disposed within said pan body and separating an interior of said pan body into a first oil chamber and a second oil chamber oil chamber;

said partition provided with at least two overflow openings in said partition and extending between said oil chambers;

an adjustable closure element common to said at least two overflow openings, said adjustable closure element operable to open or close said at least two overflow openings;

wherein said closure element is an elongated drain screw extending through said drain opening from an exterior to an interior of said pan body, wherein said partition has a first wall section on a side of said second oil chamber and a second wall section on an opposing side of said second oil chamber;

wherein a first one of said at least two overflow openings extends through said first wall section and connects said first and said second oil chambers, wherein a second one of said at least two overflow openings extends through said second wall section and connects said first and second oil chambers, wherein said drain screw extends from said drain opening into said first oil chamber, continues across said first oil chamber and through said first overflow opening of said first wall section into said second oil chamber, wherein said drain screw continues to extend from said first overflow opening through said second oil chamber and into said second overflow opening in said opposing second wall second wall section, said second wall section separating said second oil chamber from said first oil chamber, wherein said drain screw is adjustable between a closing position and an open position, wherein in said open position said first and second overflow openings and said drain opening are opened to permit oil flow through said openings, wherein said drain screw includes:

a first sealing location operable to close said drain opening when in said closed position;

a second sealing location operable to close said first overflow opening;

a third sealing location operable to close said second overflow opening;

a thermostatic element that forms a section of said elongated drain screw, said thermostatic element responsive to temperature changes in the oil to axially change position of said second sealing location, said position change operable to open or close said first overflow opening.

2. The oil pan according to claim 1, wherein said closure element is arranged in an intermediate space between said wall sections and extends across said second oil chamber from said first overflow opening to said second overflow opening, wherein said thermostatic element responsive to temperature changes in the oil axially changes position of said third sealing location, said position change operable to open or close said second overflow opening.

3. The oil pan according to claim 2, wherein said partition is U-shaped.

4. The oil pan according to claim 1, wherein in said closed position said at least two overflow openings are closed by said drain screw and in said open position said at least two overflow openings are opened to permit oil flow between said oil chambers through said at least two overflow openings.

5. The oil pan according to claim 1, wherein said closure element is a thermal valve that upon surpassing a switching temperature is moved from a closed position into an open position, said open position permitting oil flow between said oil chambers through said at least two overflow openings.

6. The oil pan according to claim 1, wherein said partition is connected to an inner bottom of said oil pan by a tongue-and-groove arrangement.

7. An oil pan comprising two separate oil chambers that are separated by a partition in which at least one overflow opening is provided, wherein said partition has a first wall section on a side of said second oil chamber and a second wall section on an opposing side of said second oil chamber;

wherein a first one of said at least two overflow openings extends through said first wall section and connects said first and said second oil chambers, wherein a second one of said at least two overflow openings extends through said second wall section and connects said first and second oil chambers, wherein said drain screw extends from said drain opening into said first oil chamber, continues across said first oil chamber and through said first overflow opening of said first wall section into said second oil chamber, wherein said drain screw continues to extend from said first overflow opening through said second oil chamber and into said second overflow opening in said opposing second wall second wall section, said second wall section separating said second oil chamber from said first oil chamber, wherein for opening and closing said at least one overflow opening an adjustable closure element is provided, wherein said at least one closure element is an oil drain screw that is operable external to said oil pan and adjustable between a closed position and an open position, wherein in said closed position said at least one overflow opening is closed by said drain screw and in said open position said at least one overflow opening is opened to permit oil flow between said oil chambers through said at least one overflow opening, wherein said drain screw extends from said drain opening into said first oil chamber, continues across said first oil chamber and through said first overflow opening of said first wall section into said second oil chamber, wherein said drain screw continues to extend from said first overflow opening through said second oil chamber and into said second overflow opening in said opposing second wall second wall section, said second wall section separating said second oil chamber from said first oil chamber, wherein in said open position said first overflow opening is opened to permit oil flow through said first overflow opening, wherein said drain screw includes:

a thermostatic element that forms a section of said drain screw, said thermostatic element responsive to temperature changes in the oil to axially change position of a sealing location closing off said first overflow opening, said position change operable to open or close said first overflow opening.

8. The oil pan according to claim 1 wherein said at least one overflow opening has a cross-sectional surface area that is matched to a viscosity of the oil in the oil pan such that the oil is capable of passing through said at least one overflow opening only when the viscosity is below a viscosity limit, wherein said at least one overflow opening is covered by a nonwoven having a permeability that is matched to a viscosity of the oil in the oil pan such that the oil is capable of passing through said nonwoven only when the viscosity is below a viscosity limit.

* * * * *